US005989083A

United States Patent [19]

Ishigaki et al.

[11] Patent Number: 5,989,083

[45] Date of Patent: Nov. 23, 1999

[54] WATER JET PROPULSION DEVICE FOR VESSELS

[75] Inventors: Eiichi Ishigaki; Kazumitsu Oura, both of Sakaide, Japan

[73] Assignee: Ishigaki Company Limited, Tokyo, Japan

[21] Appl. No.: 08/765,302

[22] PCT Filed: Apr. 25, 1996

[86] PCT No.: PCT/JP96/01129

§ 371 Date: Apr. 21, 1997

§ 102(e) Date: Apr. 21, 1997

[87] PCT Pub. No.: WO96/33909

PCT Pub. Date: Oct. 31, 1996

[30] Foreign Application Priority Data

| | | | |
|---|---|---|---|
| Apr. 28, 1995 | [JP] | Japan | 7-129422 |
| Jun. 16, 1995 | [JP] | Japan | 7-174000 |
| Nov. 22, 1995 | [JP] | Japan | 7-328320 |
| Nov. 27, 1995 | [JP] | Japan | 7-332803 |

[51] Int. Cl.[6] ..... B63H 11/01

[52] U.S. Cl. ..... 440/46; 440/42; 440/47

[58] Field of Search ..... 440/1, 48, 38, 440/46, 47, 40, 42, 43, 67, 66, 41

[56] References Cited

U.S. PATENT DOCUMENTS

| | | | |
|---|---|---|---|
| 1,497,665 | 6/1924 | Kaplan . | |
| 3,082,732 | 3/1963 | Stallman | 440/48 |
| 3,147,733 | 9/1964 | Engel | 440/66 |
| 3,253,567 | 5/1966 | Patton, Jr. | 440/46 |
| 3,306,046 | 2/1967 | Trapp . | |
| 3,336,752 | 8/1967 | Smith . | |
| 3,680,315 | 8/1972 | Aschauer et al. | 60/221 |
| 3,737,249 | 6/1973 | Cooper | 416/179 |
| 3,918,256 | 11/1975 | Ashleman | 440/41 |
| 3,942,463 | 3/1976 | Johnson, Jr. et al. | 60/224 |
| 4,055,140 | 10/1977 | Kirchhan | 114/227 |
| 4,449,944 | 5/1984 | Baker et al. | 440/47 |

FOREIGN PATENT DOCUMENTS

| | | | |
|---|---|---|---|
| 0399343 | 11/1990 | European Pat. Off. . | |
| 0527227 | 2/1993 | European Pat. Off. . | |
| 1310135 | 10/1962 | France | 440/48 |
| 2625818 | 12/1977 | Germany . | |
| 300606 | 9/1932 | Italy | 440/48 |
| 5-278683 | 10/1993 | Japan | 440/42 |
| WO 88/09288 | 12/1988 | WIPO | 440/42 |

OTHER PUBLICATIONS

Copy of European Search Report for EP 96 91 2237.

*Primary Examiner*—Sherman Basinger
*Attorney, Agent, or Firm*—Howard & Howard

[57] ABSTRACT

A water jet propulsion device for a vessel in which a suction inlet 4 is open at a vessel bottom part in a vicinity of a stern, water suctioned from the suction inlet 4 to a suction duct 5 is pressurized by a spiral blade 10 provided in an impeller housing 6, and jet water is ejected from an ejection duct 13 backward of the stern, and moreover, on an impeller shaft 7 provided in the impeller housing 6 are disposed a plurality of those spiral blades 10 with slipped phases, outer peripheral parts 10*b* of the spiral blades 10 are close to an inner circumferential surface of the impeller housing 6, and outer circumferential end parts 10*c* of the spiral blades 10 are extended to a suction side, and further in a fluid passage behind the spiral blades 10 are provided guide vanes 12, and cavitations and a rolling of a vessel body in a high-speed travelling are reduced, and a travel performance is improved.

8 Claims, 11 Drawing Sheets

PROPULSION DEVICE OPERATING MECHANISM

GRID ACTUATION SYSTEM

FORWARD/BACKWARD MOVEMENT CHANGEOVER SYSTEM

WATER JET PROPULSION DEVICE FOR VESSELS

FIELD OF ART

This invention relates to a water jet propulsion device for vessels, and particularly, to a propulsion device which in high-speed travel reduces the roll of a vessel body as well as the cavitation, and has improved travelling performance.

BACKGROUND ART

As conventional propulsion devices for vessels of this type, there are known ones (for example, Japanese Utility Model Publication No. 1-27517) in which the propeller is made like a leaf, a plurality of those propellers are arranged on a propeller shaft, and the propellers have outer tubes provided on outer peripheral parts thereof for giving pressures.

Moreover, there is described in the Specification of Japanese Patent Application Laid-Open Publication No. 5-270486 a device that has a rotatable guide vane provided at a suction inlet of a suction duct, for changing the direction of inflowing water to the suction duct. Further, the Specification of Japanese Utility Model Publication No. 1-29200 has described therein also a device provided with a guide vane for guiding external water to a fin projected under a suction inlet. Furthermore, in Japanese Patent Publication No. 56-40078 for example, there is described also a device in which, when the propulsive force is reduced with drift matters adhering to a grid of a suction inlet, a fork-like member is rearwardly rotated to remove the drift matters.

Still more, there is described in Japanese Patent Application Laid-Open Publication No. 5-278683 also a propulsion device in which a deflection plate is provided at a bottom opening of a steering column, and jet water is frontwardly deflected with a rotatable flap.

However, in conventional water jet propulsion devices, although high-speed travel is permitted, as the blade width of an impeller is short, there is a problem that vortices occur with an increase in number of revolutions of the impeller. Still less, as the travel speed becomes high, the inflow rate of water incoming to a suction duct at a headway direction side decreases, developing low-pressure stream regions, causing cavitation phenomena on blade surfaces of the impeller, so that there may be vibrations and noises and a concurrent roll. And, in a device which has as a measure for prevention of cavitation a mobile guide vane provided at a suction inlet for changing the inflow direction to a suction duct, it may constitute an obstacle to inflowing water in high-speed travel. And, in a device which has a guide blade provided outside a suction inlet, though being able to increase the inflow rate to a suction duct, it may constitute a water fluid resistance, as the vessel moves astern or makes a turn, failing to achieve a rapid directional change.

Further, in a device provided with a grid at a suction inlet, although it has a favorable removability to solid bodies such as a driftwood, those drift matters which have a flexible nature may adhere to the grid or flow into a suction duct, binding an impeller, with a lowered performance causing a reduced propulsive force or a failure to travel. And, in a device in which adhering drift matters are removed from a grid, there is needed a speed reduction of a vessel, in addition to a manual operation. Yet less, in a device which has at a bottom part of a steering column a deflection plate provided for a reverse propulsion guide, it may constitute a water fluid resistance in high-speed travel. The invention of the present application has for its object to provide a propulsion device with improved suction performance and improved travelling performance, and a water jet propulsion device which removes drift matters adhering to a grid, while travelling, and which is small of a reduction in reverse propulsive force, when travelling astern, and free of a sudden braking nor a lateral slip, when performing a change between a forward movement and a backward movement.

DISCLOSURE OF THE INVENTION

The invention of the present application has, in a propulsion device in which a suction inlet is open at a vessel bottom part in a vicinity of a stern, water suctioned from the suction inlet to a suction duct is pressurized by an impeller provided in an impeller housing, and jet water is ejected from an ejection duct in a backward direction of the stern, an arrangement such that on an impeller shaft in the impeller housing are provided a plurality of spiral blades with slipped phases, which spiral blades have their outer peripheral parts close to an inner circumferential surface of the impeller housing, for an increased balancing efficiency and an increased volumetric efficiency, and their outer circumferential end parts extending to a suction side, for the suction inlet to be formed wide for an increased suction performance, and to permit drift matters inflowing to the suction duct to pass through. And, a passage of a basin shape is formed with a bearing case of the impeller shaft and the impeller housing, and behind the spiral blades are provided guide vanes which are constituted with a plurality of long twisted guide vanes, so that swirling streams pressurized by the spiral blades are guided to be straight streams for an increased propulsive efficiency.

On a front end opening peripheral part at the suction inlet of the suction duct is disposed a flow introducing member of an arcuate form in a view from aside a body of a vessel body, for having water streams at a bottom part of the vessel in travel arcuately guided along the flow introducing member to the suction inlet, so that the water streams evenly income also to a front stage part of the suction duct in a travelling direction. And, in a central zone of the suction inlet is provided a stabilizing plate, which stabilizing plate is secured to be fixed to front and rear opening edge parts of the suction inlet 4 and projects under a vessel bottom, for a rectification of suction water streams to the suction duct and for a prevention of a lateral slip in a turn. In a front-rear direction of the suction inlet are parallelled mobile grids, which mobile grids have their rear end parts rotatably pivoted on a rear end opening periphery of the suction inlet, and there are provided a vessel speed sensor for sensing a travel speed of the vessel and a revolution number sensor for sensing a number of revolutions of the spiral blades and further a rotation device operable, when the vessel has a lowered travel speed under a set value computed in trial from the number of revolutions of the spiral blades, for causing the mobile grids to secede from the suction inlet of the suction duct, to remove adhering drift matters from the grids by water streams, while travelling, for a propulsion performance to be recovered.

Moreover, behind the ejection duct is provided a steering nozzle, which steering nozzle has a reverse ejection outlet disposed at a bottom part thereof, which reverse ejection outlet has provided at a rear end opening periphery thereof a changeover valve pivotably attached thereto at a base end part thereof so that the reverse ejection outlet and an ejection outlet at a back are able to be open and close, for a reduction of a reverse propulsive force to be minimized when moving astern. And, there is provided a revolution number control device responsive to the changeover valve, as it is rotated for a changeover between a forward movement and a backward movement, for reducing the number of revolutions of the spiral blades and having a predetermined time interval elapse before recovering the number of revolutions, which revolution number control device is interlocked with the rotation device to prevent a sudden braking of the vessel body and a lateral slip.

Further, the present invention is an invention that has a plurality of spiral blades wound on an impeller shaft provided at a stern, and an impeller casing disposed over outer circumferential parts of the spiral blades. The impeller casing is formed with a funnelled suction inlet, an elliptic body part and a discharge outlet having a contracted opening, with an arrangement having provided, on an inner circumferential surface behind the suction inlet and on an inner circumferential surface in front of the discharge outlet, a plurality of vertical rectification plates extending in an axial direction of the impeller shaft and a plurality of guide vanes for swirling streams to be rectified in the axial direction of the impeller shaft, so as to be free from influences of complicated streams of water near the stern, and in particular, with the spiral blades made as oblique stream vanes for an increased propulsive force.

The invention of the present application has the before-described arrangement in which, as the spiral blades are rotated, a body of water such as marine water is suctioned from the suction duct to be supplied to start end parts of the spiral blades. Then, the inflowing water is pressurized with continuous spiral blade surfaces of the spiral blades, being accelerated, to be transferred along the basin-like passage of the impeller housing. Next, the accelerated spirally swirling streams are guided along the twisted guide vanes in an axial direction of the impeller shaft so that they are rectified, to be ejected as jet water from the ejection outlet rearwardly of the stern. Accordingly, a discharge centerline is substantially the same as a water surface, with a minimized actual lift, permitting a direct use of water streams under pressures increased by the spiral blades. And, with the spirally formed vanes having their outer circumferential end parts extending to the suction side, there is defined a wide suction inlet as well as a wide passage, for an improved suction performance, and to permit inflowing drift matters to pass through, preventing the spiral blades from a binding such as of fibers.

As the vessel is traveling, water streams along the vessel bottom part have low pressures behind the arcuate flow introducing member formed on the front end opening peripheral part of the suction inlet. Therefore, the water streams along the vessel bottom part are suctioned to the low-pressure region and guided along the outer circumferential surface of the flow introducing member, flowing into the suction duct. As a shift proceeds to a high-speed travel, the flow introducing member has therebehind the lower pressures, with an increased water inflow rate. Accordingly, the suction duct is kept from becoming negative in pressure at the front stage part, preventing the cavitation, permitting the impeller to keep a suction performance. And, the stabilizing plate provided in the central zone of the suction inlet serves for prevention of a disturbance of inflowing water to the suction inlet, and prevention of roll in a high-speed travel.

Drift matters tending to inflow the suction duct are prevented by the grids, or caught to be kept from flowing into the impeller housing. However, as the time elapses, the suction inlet becomes blocked with drift matters caught by the grids, causing a reduced suction performance and a reduced propulsion performance. Thus, as the travel speed of the vessel is lowered relative to the revolution number of of the spiral blades so that the travel speed is reduced to be under the set value, the grids are automatically rotated from the suction inlet backwardly of a travel direction, to have the adhering drift matters on the grids washed away with water streams at the bottom of the vessel in travel, before the grids are rotated to be fitted to the suction inlet. By doing so there is given an increased suction performance, permitting the travel speed to be recovered.

Next, the water pressurized and accelerated by the spiral blades is ejected at a rear end of the steering nozzle, and by a reaction force of its discharge pressure the vessel is driven to travel. And, when having the vessel stop or drop astern, the changeover valve shutting off the reverse ejection outlet of the steering nozzle is rotated toward the ejection outlet, so that the ejection outlet is shut by the changeover valve, and the pressurized water is ejected obliquely downwardly of the headway direction, permitting a prompt adaptation from a full-speed forward movement to a stop or to a full-speed backward movement. Moreover, the number of revolutions of the spiral blades can be reduced for a predetermined time in a changeover between a forward movement travel and a backward movement travel by the revolution number control device of the spiral blades, thus permitting a sudden braking of the vessel body to be avoided and a concurrent use of the stabilizing plate to prevent a thrust of the vessel. Further, as a propulsion changeover device is disposed within the steering nozzle, it hardly constitute a water fluid resistance when travelling headway. In addition, when dropping astern, ejected water is kept from dispersion, without reducing the propulsive force, either.

Still more, in the invention, as the spiral blades are rotated, water such as marine water is suctioned from the suction inlet of the impeller casing, supplied along the rectification plate to the start end parts of the spiral blades, and transferred along the series of twisted guide surfaces of the spiral blades, being pressurized to be accelerated by the guide surfaces. Next, the accelerated water streams are let by the guide vanes to run as rectified streams in the axial direction of the impeller, to be ejected astern from the contracted opening of the discharge outlet as yet accelerated jet streams, of which a reaction force propels the vessel body. Accordingly, it can be prevented for water streams to be dispersed causing complicated streams of water flow in a vicinity of the stern.

MOST PREFERABLE EMBODIMENTS FOR EXECUTION OF THE INVENTION

Figure 1:
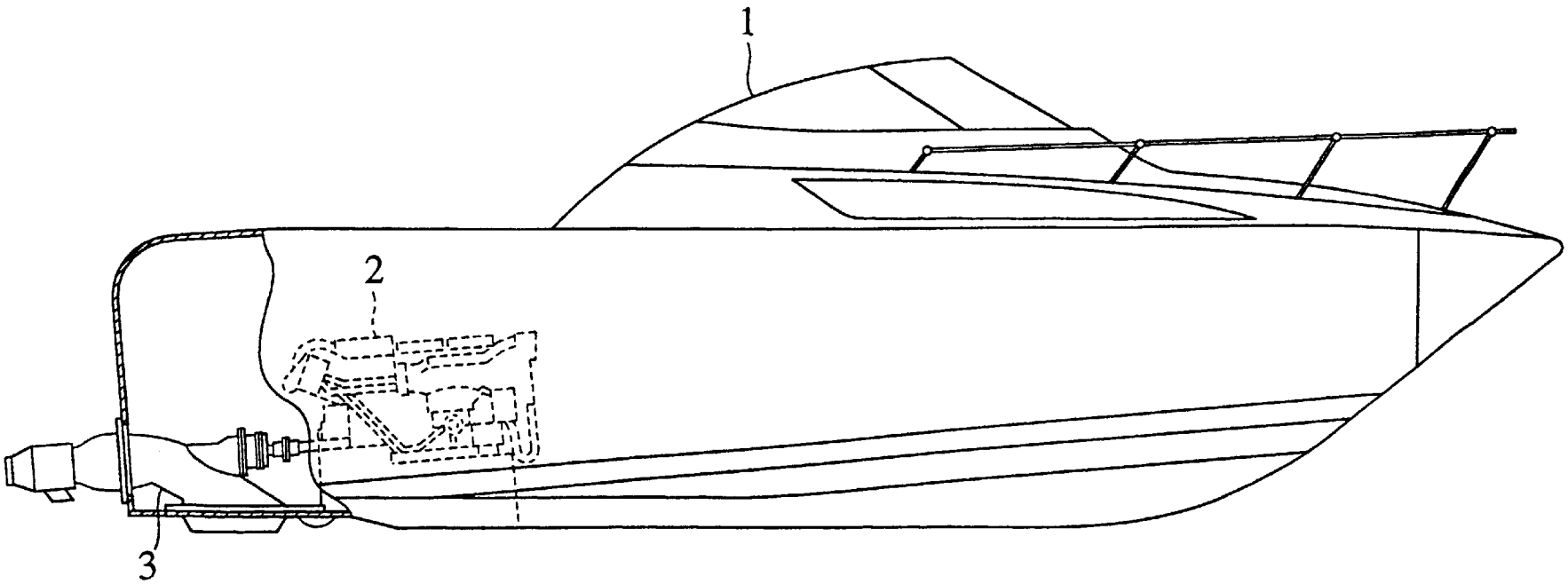
FIG. 1 is a partially cut-out side view of a vessel in which a water jet propulsion device is arranged.
Figure 2:
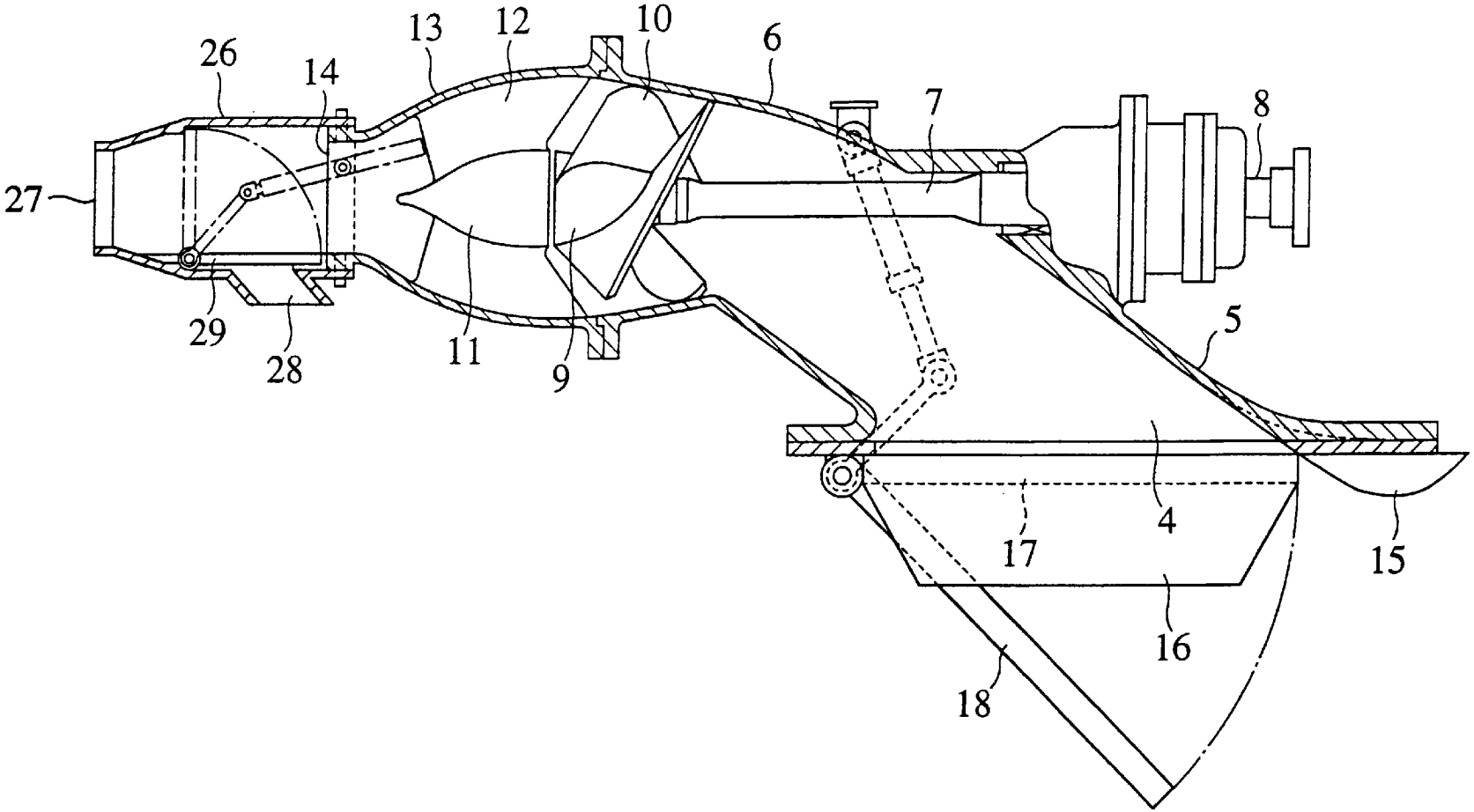
FIG. 2 is a side view, in section, of a water jet propulsion device according to the invention.
Figure 3:
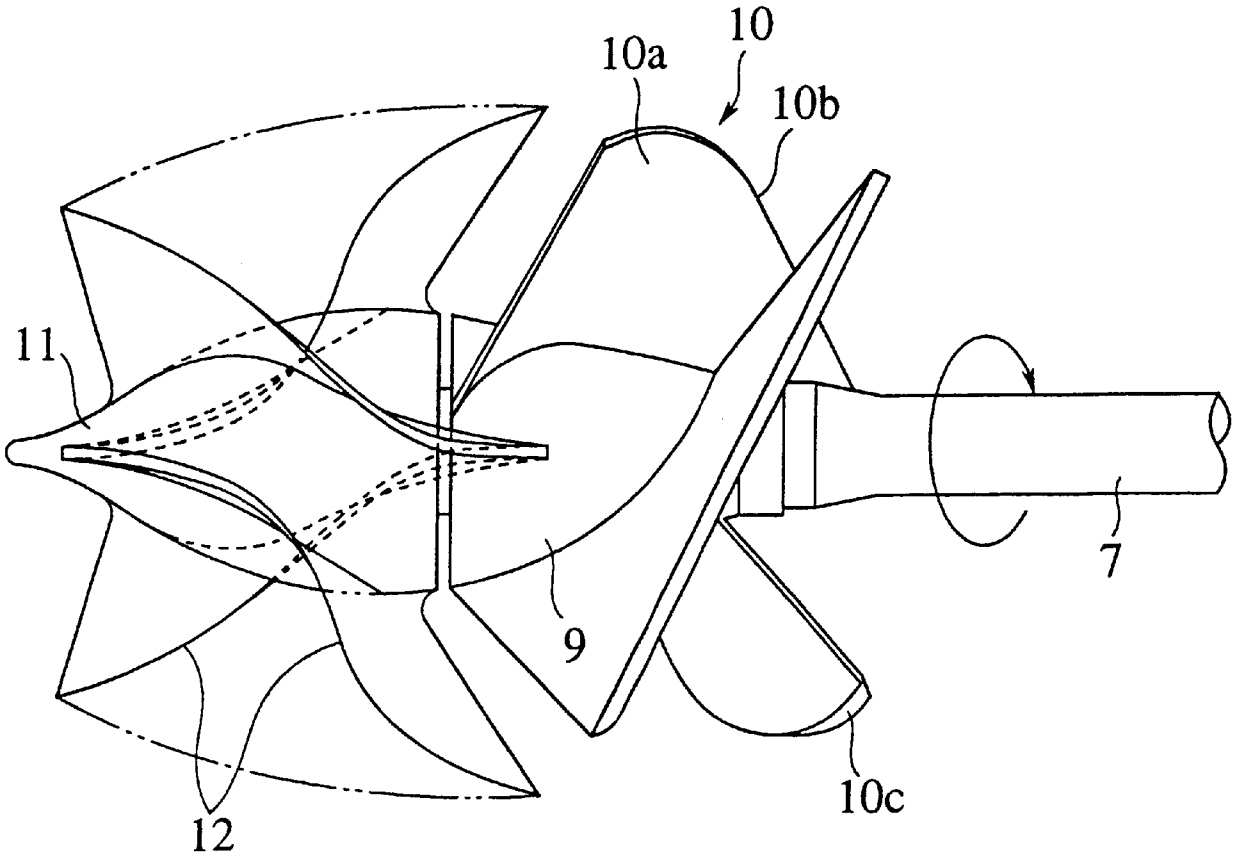
FIG. 3 is a side view showing an impeller and guide vanes of the propulsion device according to the invention, as they are taken out from a housing.

The invention of the present application will be described into detail with reference to the drawings: in FIG. 1, reference character 1 is a vessel such that an engine 2 disposed at a stern of the vessel 1 has coupled thereto a water jet propulsion device 3, whereby water is suctioned from below a vessel bottom part and pressurized and accelerated, and jet water is ejected backwardly of the stern to have a reaction force thereof propel the vessel 1. Of the propulsion device 3, a detailed description will be given with reference to FIG. 2: at the vessel bottom part of the vessel 1, there is provided a suction duct 5 having a suction inlet 4, with an inclined position relative to a headway direction, so that water such as marine water suctioned from the suction inlet 4 has an increased flow rate, as the travel speed becomes high. Reference character 6 is an impeller housing continuously provided to the suction duct 5, and an impeller shaft 7 horizontally arranged in the impeller housing 6 is coupled to a drive shaft 8 of the engine 2. And, on a hub 9 provided on the impeller shaft 7, there are axis-symmetrically spirally wound a triple of spiral blades 10 at phases slipped by 120 degrees as shown in FIG. 3, with continuous twisted blade surfaces 10*a* for pressurizing and accelerating water streams in spiral centrifugal directions. An outer peripheral part 10*b* of spiral blade 10 is disposed close to an inner circumferential surface of the impeller housing 6 and the spiral blades 10 are set to be plural in number, to improve a volumetric efficiency and a balancing efficiency. Moreover, outer circumferential end parts 10*c* of the spiral blades 10 are extended to a suction side, rendering a suction inlet of the spiral blades 10 wide for an increased suction performance, and concurrently to prevent drift matters inflowing to the suction duct 5 from blocking suction parts of the spiral blades 10. Further, as the spiral blade surfaces 10*a* are long in width, inflowing fibers or the like are kept from binding. Incidentally, spiral blades 10 may be four in total in accordance with a magnitude of a vessel body. The inner circumferential surface of the impeller housing 6 constitutes a relaxed parabola as shown in FIG. 2, and a basin-like passage is formed with the impeller housing 6, the hub 9 provided on the impeller shaft 7 and a bearing case 11 of the impeller shaft 7. In a passage behind the spiral blades 10, there are provided a total of four long twisted guide vanes 12 connected at their both ends to the impeller housing 6 and the bearing case 11 of the impeller shaft 7. As shown in FIG. 3, the guide vanes 12 are made at their start end sides to be spiral like the spiral blades 10 and at their finish end sides to be parallel with an axial line of the impeller shaft 7, to form a passage for rectification such that spiral swirl streams of water pressurized and accelerated by the spiral blades 10 are guided to be parabolic at start end parts of the guide vanes 12 and converted into straight streams at finish end parts of of the guide vanes 12, to have pressurized water taken out from an ejection outlet 14 of of an ejection duct 13 that is contracted to be open.

Figure 4:
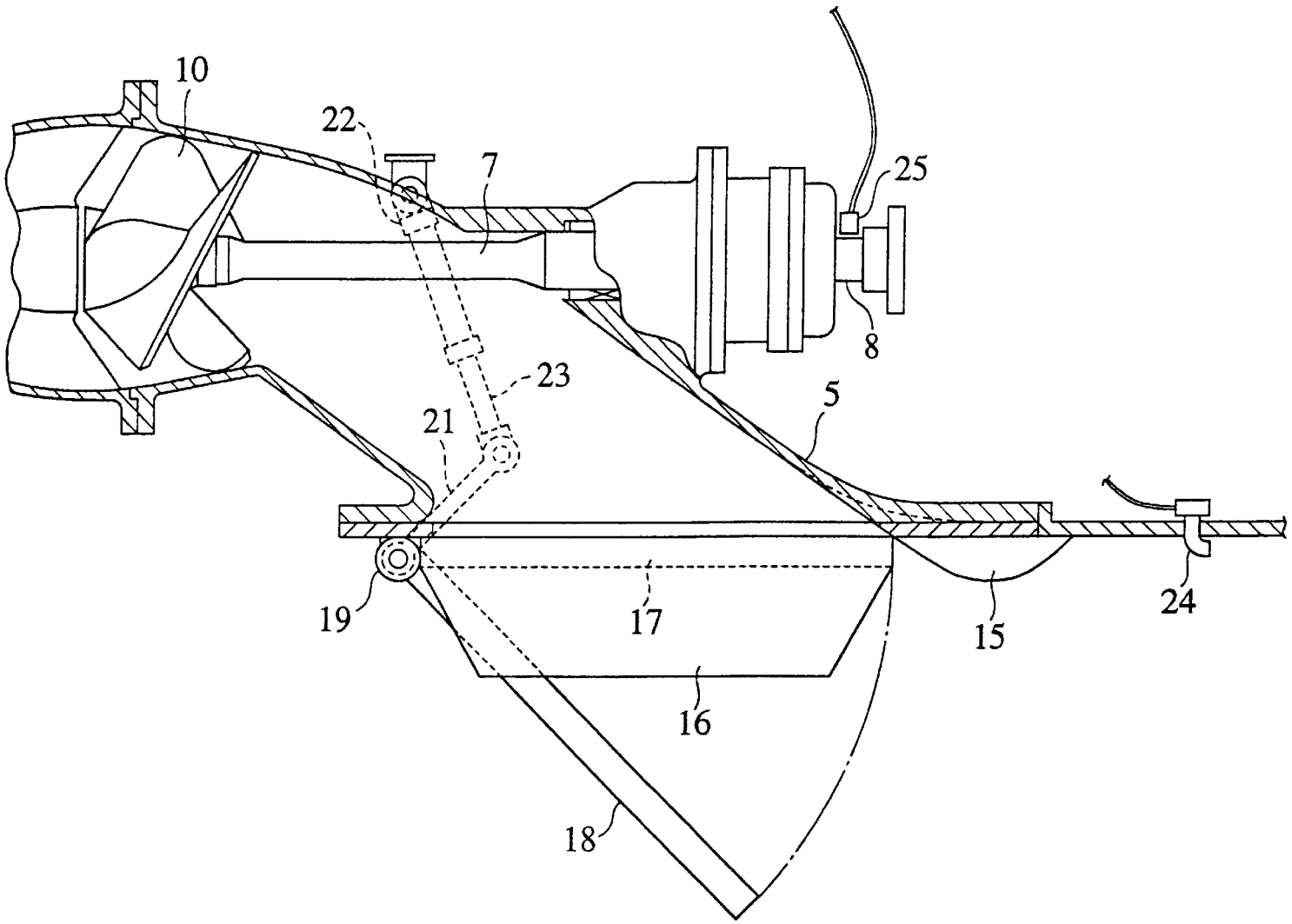
FIG. 4 is a side view, in section, showing a suction duct of an essential part of the propulsion device according to the invention and a working state of a mobile grid provided on the suction duct.
Figure 5:
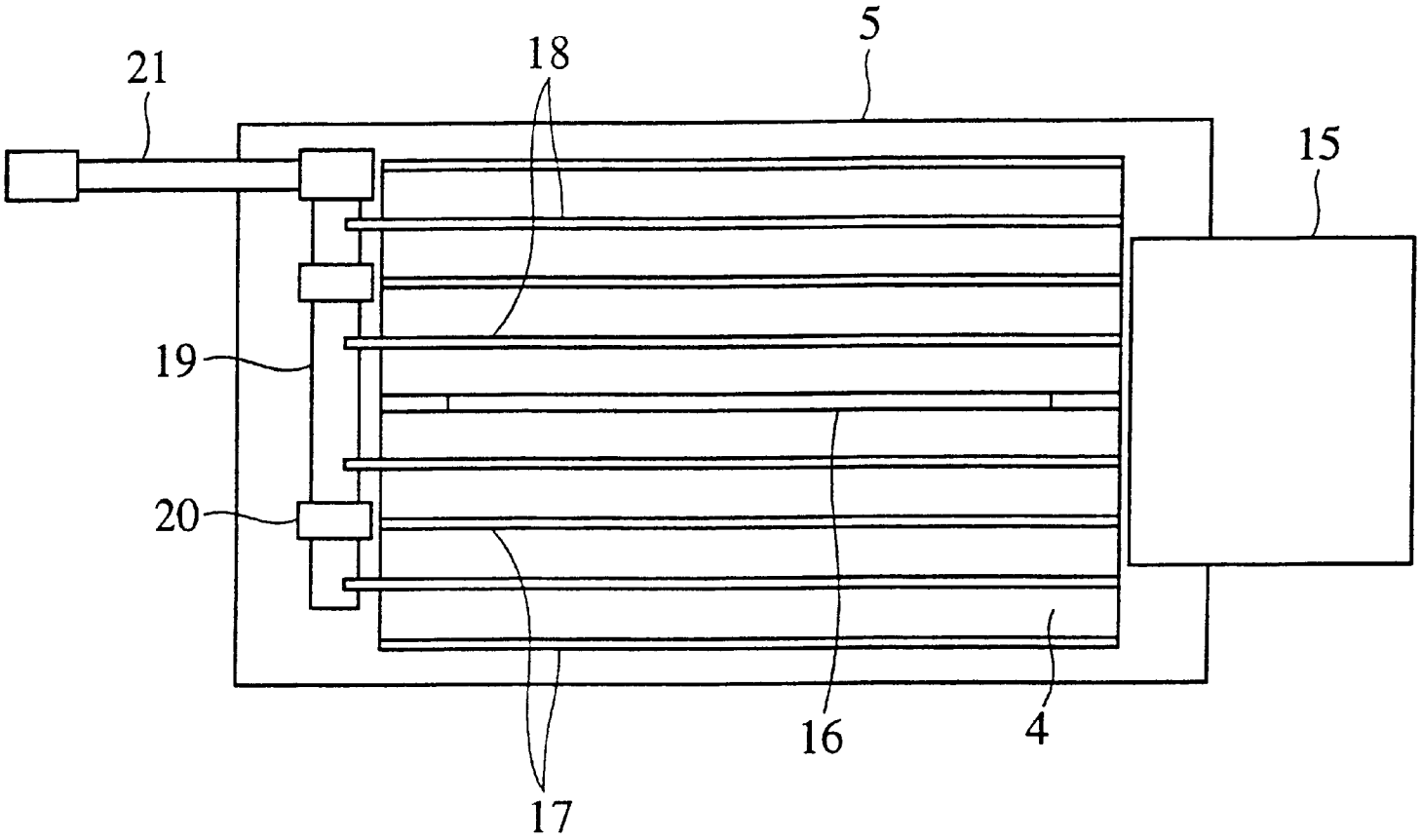
FIG. 5 is a bottom view showing a suction inlet of the suction duct of the propulsion device according to the invention, as a mobile grid is attached thereto.

The suction inlet 4 of the suction duct 5 has at a front end opening peripheral part thereof a flow introducing member 15 formed thereon to be arcuate in a side view as shown in FIGS. 2 and 4. By the flow introducing member 15, water streams flowing under the vessel bottom are suctioned behind the flow introducing member 15, where low pressures are developed due to water streams in travel, so that they are guided by a surface of the flow introducing member 5, permitting water to be supplied to a front stage part of the suction duct 5 in terms of a travel direction, where a low-pressure region tends to appear. Moreover, the suction inlet has in a central zone thereof a stabilizing plate 16 secured to be fixed at both ends thereof to front and rear opening edges of the suction inlet 4 and projected under the vessel bottom, while extending in a front-rear direction. The stabilizing plate 16 is for preventing a disturbance of water streams inflowing to the suction duct 5 and for a prevention of a rolling in a high-speed travel, as well as for preventing a lateral slip in a direction change of the vessel. Further, as shown in FIGS. 4 and 5, the suction inlet 4 has a plurality of fixed grids 17 bridging between front and rear opening edges of the suction inlet 4, in parallel to the stabilizing plate 16. Furthermore, between the fixed grids 17, there are provided mobile grids 18 for checking drift matters' inflow to the suction inlet 4. At a rear end opening edge part of the suction inlet 4 there are provided bearings 20. As shown in FIG. 5, the bearings 20 rotatably support a support lever 19, which has the mobile grids 18 fixed thereto at their base ends. And, the support lever 19 is connected at one end thereof to one end of a crank shaft 21, which crank shaft 21 is connected at the other end thereof to a piston 23 of an actuation cylinder 22. And, as the piston 23 expands, the mobile grids 18 separate from the suction inlet 4 of the suction duct 5, rotating rearwardly of a headway direction of the vessel, so that drift matters are washed away from the mobile grids 18 with water streams in a travel. As the piston 23 contracts, the mobile grids 18 fit on the suction inlet 4.

Figure 6:
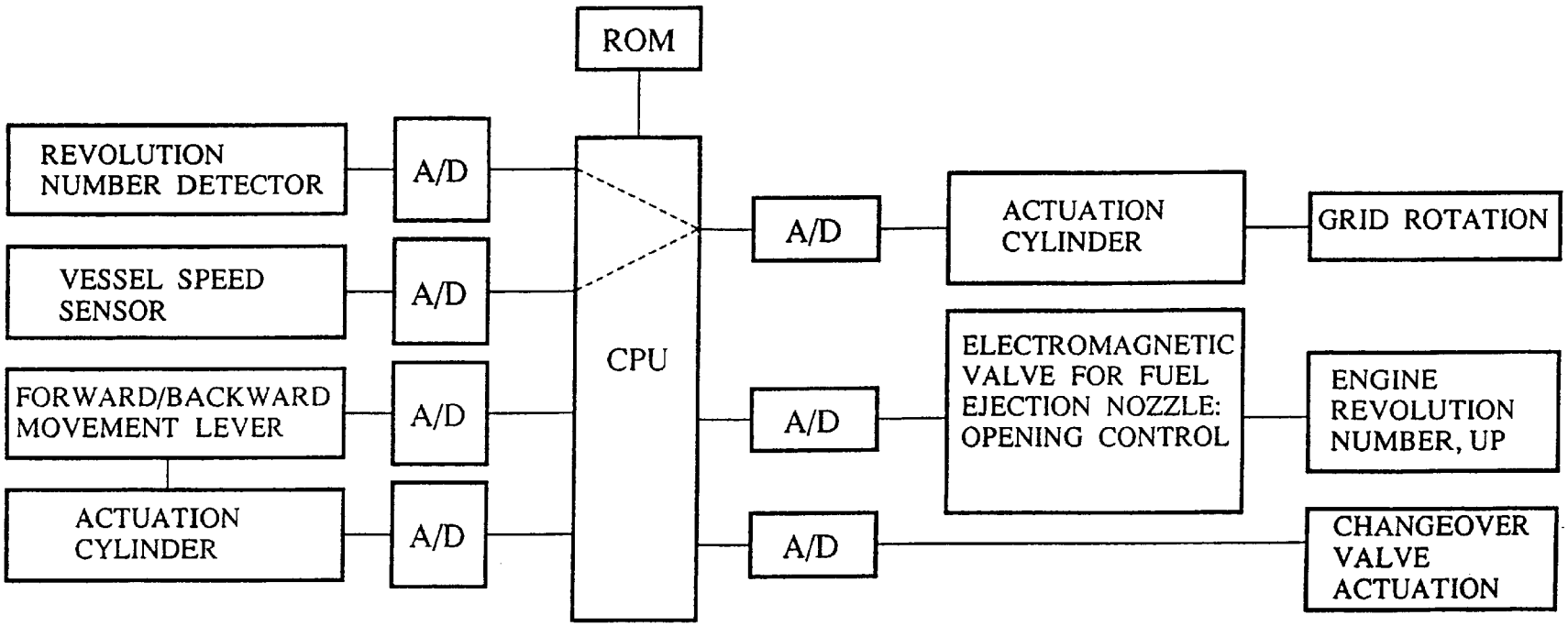
FIG. 6 is a block diagram of a schematic arrangement of a control device according to a travel changeover device and a drift matter removal device according to the invention.
Figure 7:
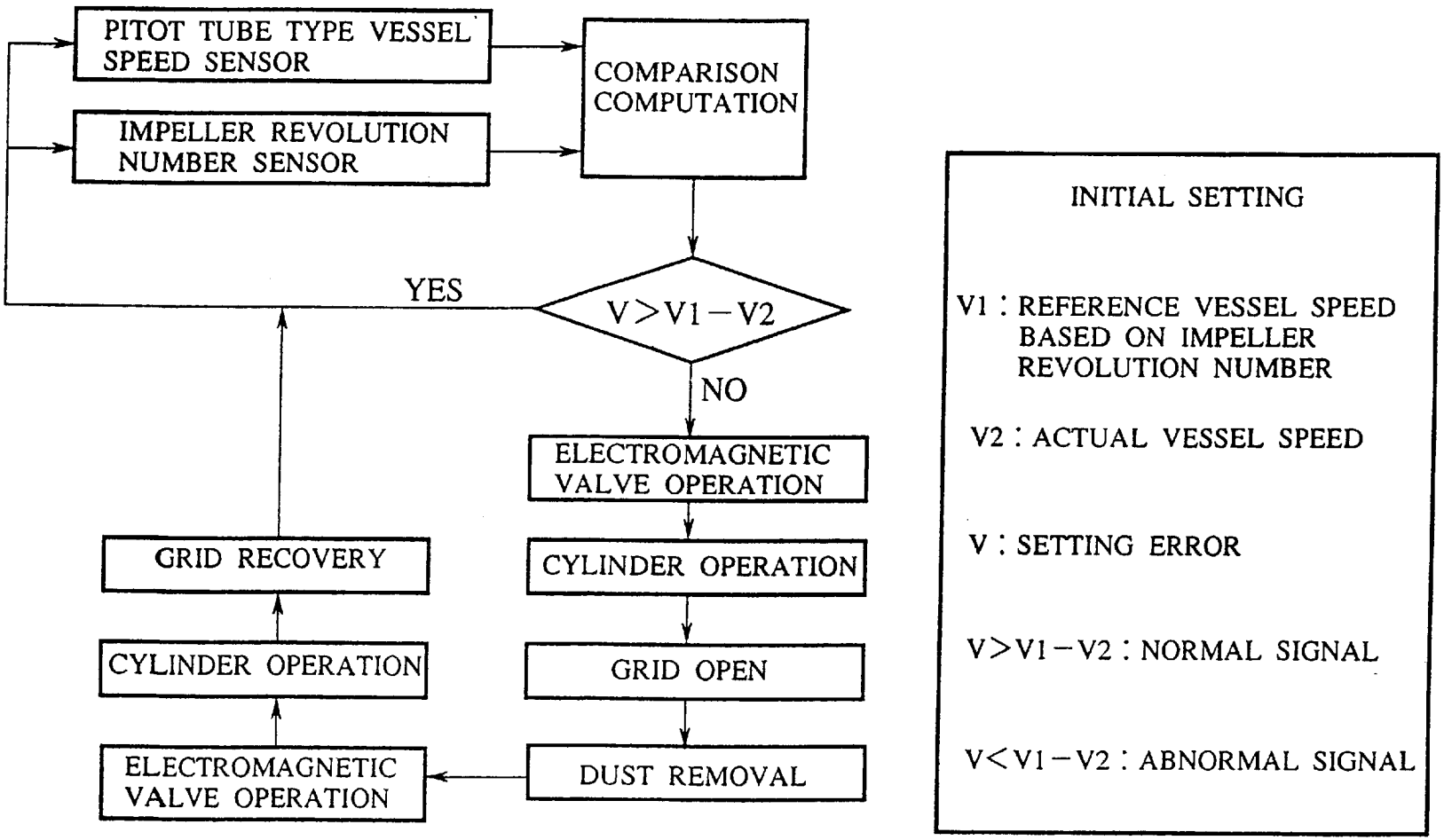
FIG. 7 is a flow chart of process operations of the drift matter removal device according to the invention.
Figure 8:
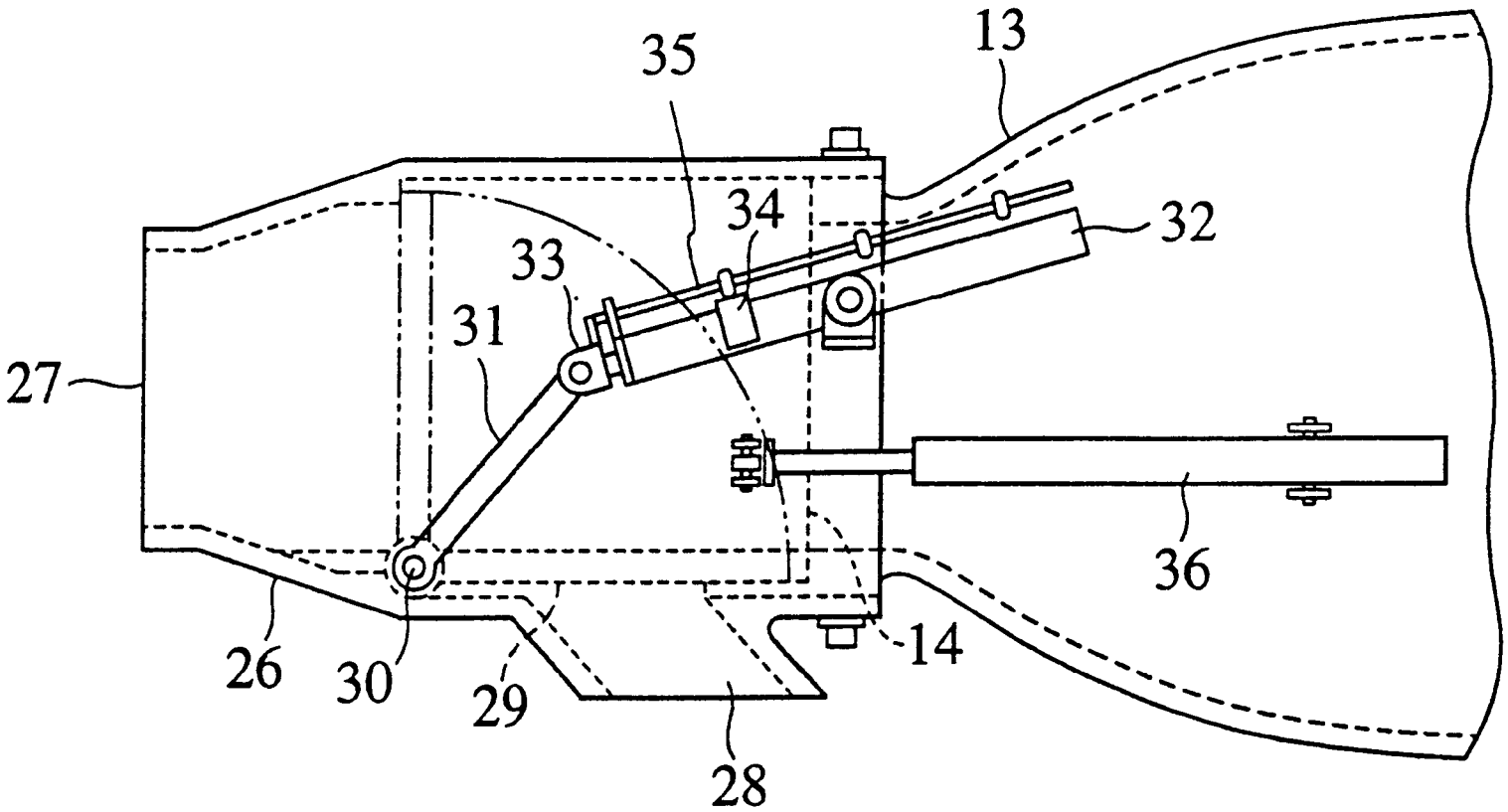
FIG. 8 is a side view of a propulsion changeover device according to the invention.

At the vessel bottom of the vessel 1, as shown in FIG. 4, there is provided a pitot tube type vessel speed sensor 24 for detecting a travel speed of the vessel 1. And, for the drive shaft 8 of the engine 2 is provided a revolution number sensor 25 to detect a number of revolutions of the spiral blades 10. And, detection signals of the vessel speed sensor 24 and the revolution number sensor 25 are transmitted as shown in FIG. 6 to a central processing unit (CPU). In the central processing unit is provided a memory (ROM) of a program, which calculates a travel speed of the vessel 1 from the number of revolutions of the spiral blades 10, sets up a permissible reduction speed to a blocking of the grids 17 and 18 at the suction inlet 4 and stores this set value, and when an abnormality is detected, a control signal is output to be transmitted to the actuation cylinder 22. The control data to be stored in the memory for arithmetic operations are as shown in FIG. 7: a reference travel speed V1 computed on the basis of the number of revolutions of the spiral blades 10 as an initial setting; an actual travel speed V2 of the vessel 1; and a permissible limit speed V when the travel speed is reduced with drift matters adhering to the grids 17 and 18. And, the detection signal of the vessel speed sensor 24 on the travel speed and the detection signal of the revolution number sensor 25 undergo a comparison computation, and when a preset differential speed is such that $V>V1-V2$, i.e., within a permissible limit, then with a decision for no blocking of the grids 17, 18 due to drift matters, a travel is kept as it is. And, if $V<V1-V2$, i.e., if the permissible limit is exceeded, then the command signal is transmitted to an electromagnetic valve of a hydraulic circuit, causing the piston 23 of the actuation cylinder 22 to expand, to rotate the mobile grids 18 rearwardly of the travel direction. And, drift matters adhering to the fixed grids 17 are thereby stripped off, and dust and the like are washed away from the mobile grids 18 by water fluid resistances. Then, after a lapse of a predetermined time, the electromagnetic valve is operated for the piston 23 to be contracted, to have the mobile grids 18 rotated to fit on the suction inlet 4. Like this, the device in concern is permitted to remove drift matters from the grids 17, 18 without entering a speed-reduced travel. At the end of the ejection duct 13, as shown in FIG. 8, there is provided a steering nozzle 26 surrounding the ejection outlet 14 of the ejection duct 13. At the steering nozzle 26, its ejection outlet 27 ejects pressurized water ejected from the ejection duct 13, as jet streams of which reaction forces propel the vessel. At a bottom part of the steering nozzle 26, there are provided a reverse ejection outlet 28, and a changeover valve 29 adapted for an open-close operation of the ejection outlet 27 and the reverse ejection outlet 28.

The changeover valve 29 is rotatably pivoted at a base end part thereof on a support rod 30 provided at an opening rear end edge part of the reverse ejection outlet 28, whereto one end of a link rod 31 is connected. The link rod 31 has pivoted at the other end thereof an end part of a piston 33 of an actuation cylinder 32. And, as the piston 33 is contracted, the changeover valve 29 shuts the reverse ejection outlet 28 of the steering nozzle 26, letting jet water eject from the ejection outlet 27 to have the vessel travel headway. On the other hand, for the vessel 1 travelling headway to drop astern, the contracted piston 33 is expanded, having the changeover valve 29 rotate to shut the ejection outlet 27. In such the manner, jet water is ejected from the reverse ejection outlet 28 obliquely downwardly of a headway direction, for the vessel 1 to change from a forward movement to a backward movement. The changeover valve 29 is adapted, when the vessel 1 travels headway, to fit tight to the bottom part of the steering nozzle 26 without influences on the ejection of water streams, and also when the vessel drops astern, it so follows that ejected water is not dispersed, as jet water has its direction changed in the steering nozzle 26.

Figure 9:
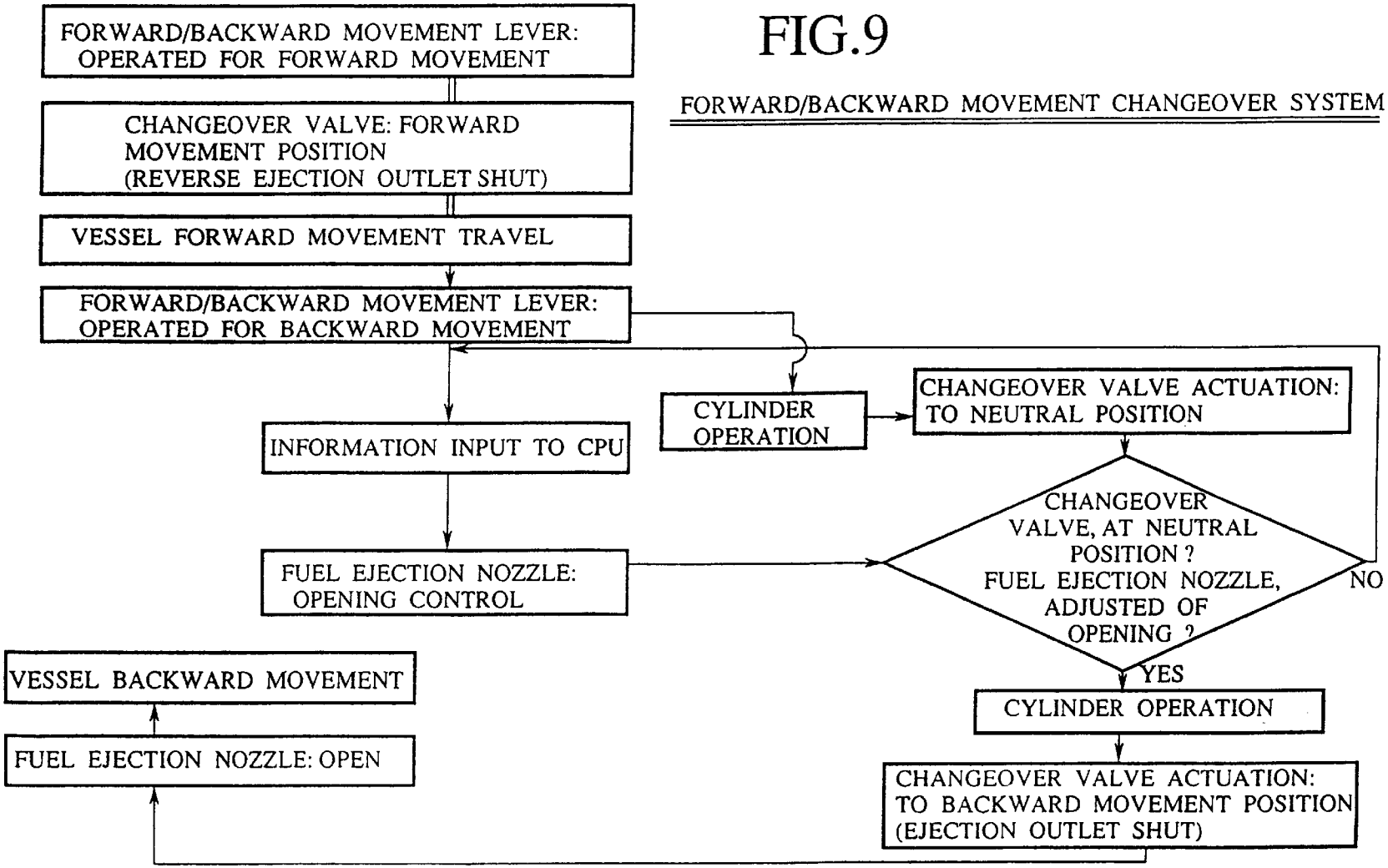
FIG. 9 is a flow chart of process operations of the propulsion changeover device according to the invention.

As shown in FIG. 8, the actuation cylinder 32 of the changeover valve 29 in contact with an inside of the steering nozzle 26 is provided with an operation detector 34. The operation detector 34 detects a started sliding of an actuation rod 35 connected to the piston 33, and transmits a detection signal thereof as shown in FIG. 6 to the central processing unit (CPU). On the other hand, the central processing unit is provided with the memory (ROM) of a program, which is responsible for the detection of a started sliding of the piston 33 to reduce the number of revolutions of the spiral blades 10 and, after a lapse of a predetermined time, to have the number of revolutions recovered. And, as shown in FIG. 9, first, a forward/backward movement lever is changed over from a forward movement operation to a backward movement operation, then an operation of the actuation cylinder 32 is detected by the operation detector 34, of which a detection signal is transmitted to the central processing unit. On a basis of this signal, an opening of a fuel injection nozzle is adjusted to decrease the number of revolutions of the spiral blades 10, so that the vessel has a reduced speed, and concurrently, the changeover valve 29 is rotated toward the ejection outlet 27 of the steering nozzle 26, to shut the ejection outlet 27. Next, the fuel injection nozzle is opened again, increasing the number of revolutions of the spiral blades 10. Then, with jet water ejected obliquely downward relative to a forward movement travel direction, the vessel travels astern. Like this, in the device in concern, the number of revolutions of the spiral blades 10 is decreased in a changeover between a forward movement and a backward movement, to prevent occurrences of a sudden braking and a thrust to the vessel body. By the way, reference character 36 is an actuation cylinder for rotating the steering nozzle 26 to the left and right to change a travel direction of the vessel.

As described above, this water jet propulsion device is one that has made vanes spiral and a suction inlet of an impeller large so that suction performance is good, and continuously connected vane surfaces perform a pressurization and an acceleration, thus permitting a high-speed travelling. Namely, in conventional water jet propulsion devices, as the number of revolutions of an impeller is increased, because of the impeller with narrow vane surfaces there are developed vortices and low-pressure regions of water streams inflowing to a suction duct, causing cavitation phenomena on the vane surfaces, producing vibrations and noises. In the invention of the present application, however, outer peripheral parts of spiral blades are set close to an inner circumferential surface of an impeller housing and their outer circumferential end parts are extended to a suction side and, hence, suction inlets of the spiral blades are enlarged, with an improved suction performance as well as with an increased suction flow due to an inducer effect of continuously connected spiral vane surfaces, permitting high-speed travelling. Moreover, because a passage is formed basin-like and long twisted guide vanes are provided for a rectification behind the spiral blades, spiral swirl streams are guided to be straight streams permitting an increased propulsive efficiency. And, as an arcuate flow introducing member is provided at a front end opening edge part of the suction inlet, water streams in travel are guided to a front stage part of a suction duct, where low-pressure flow regions tend to occur, so that water streams evenly inflow to the suction duct, permitting a prevention of cavitation. Further, with a stabilizing plate at the suction inlet, there is achieved a rectification of suction water streams to the suction duct, and a prevention of a rolling of the vessel as well as of a lateral slip when changing a travel direction.

And, in the invention of the present application, when grids have drift matters adhering thereto with a reduced suction performance, it can be done to automatically remove the dust from the grids. Namely, in conventional devices having a suction duct provided with a grid it is necessary to stop a vessel or have a decreased speed for labor work to remove drift matters from the grid; the invention of the present application however is such one that a differential speed is computed between a reference travel speed and an actually measured travel speed, and mobile grids are backwardly rotated to permit a use of travel water streams for backwardly washing away dust and the like adhering to grids, without the need of a speed-reduced travel nor of labor work for removal of drift matters. Moreover, in the invention of the present application, a forward movement and a backward movement can be effected by operation of a changeover valve provided inside of a steering nozzle. Namely, in conventional devices a changeover device constitutes a water fluid resistance when travelling headway; the invention of the present application however is one that, because of no changeover device constituting a water fluid resistance when travelling, a forward movement or a backward movement can be performed without reductions of a propulsive force. And, in a changeover of a travel, for a predetermined time an impeller has a reduced number of revolutions and a vessel has a reduced speed before a changement between forward and backward movements, so that the vessel is preventable of a sudden braking, a lateral slip thrust.

Figure 10:
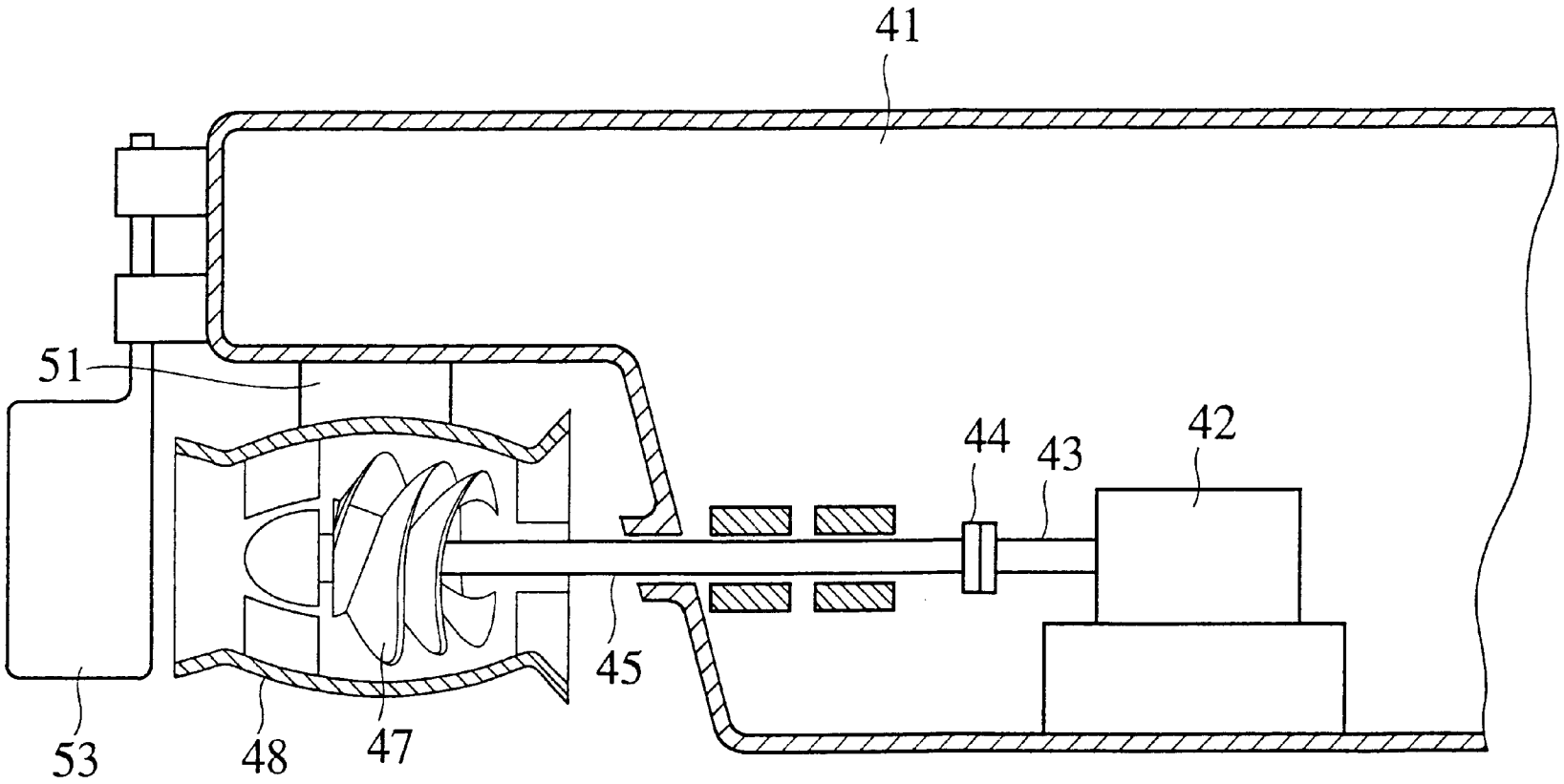
FIG. 10 is a schematic side view, in section, showing another propulsion device for vessels according to the invention.
Figure 11:
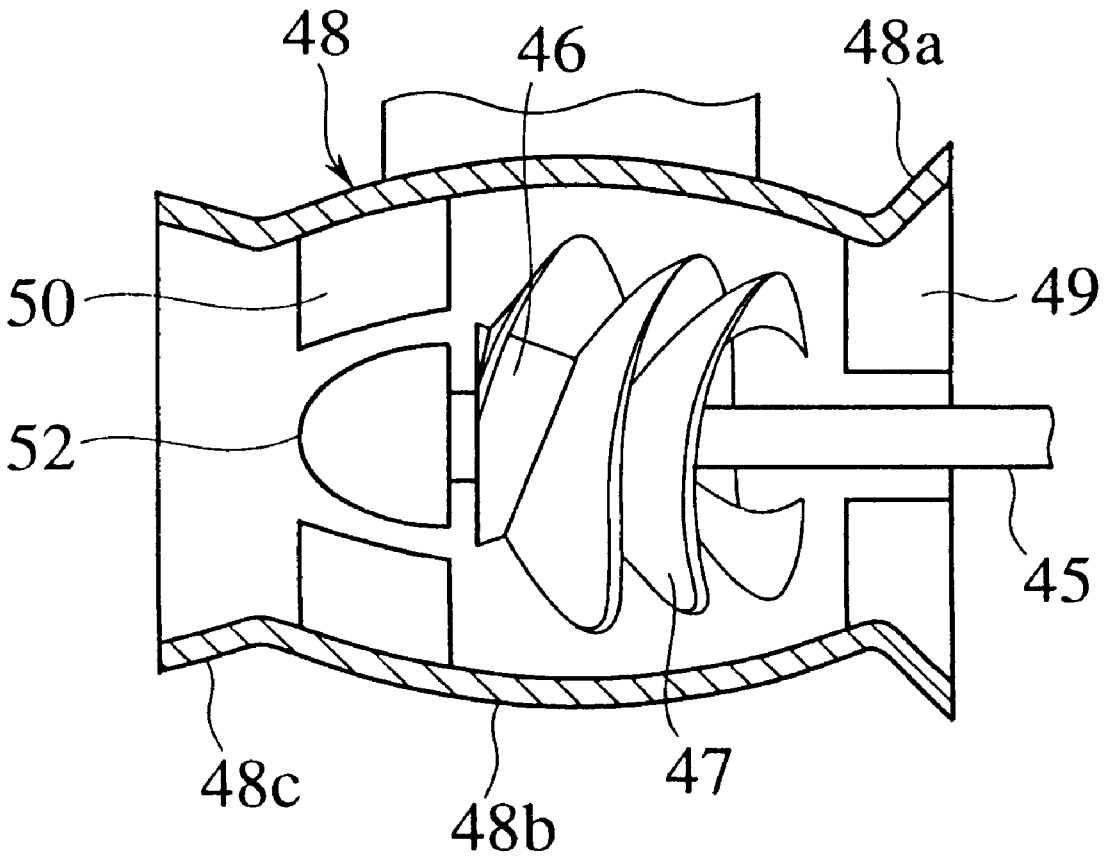
FIG. 11 is a side view, in section, showing an essential part of the propulsion device of FIG. 10, as an impeller casing and spiral blades are arranged.

Next, there will be described another embodiment of the present invention. FIG. 10 and FIG. 11 show an example of a case in which a propulsion device is not assembled in a vessel body but installed outside. In FIG. 10, reference character 41 is a vessel body, of which a stern is provided with an engine 42, and a drive shaft 43 of the engine 42 is connected via a coupling 44 to an impeller shaft 45 projecting outside the vessel. As shown in FIG. 11, at an end of the impeller shaft 45, there is provided a conical hub 46 connected at a vertex end of a circular-cone-like form thereof to the impeller shaft 45. The hub 46 is provided with a plurality of spiral blades 47, which spiral blades 47 have their end parts fixed, with phases slipped in a circumferential direction at equivalent intervals. In the embodiment there are wound a pair of spiral blades 47; the spiral blades 47 may be three or four to have an increased balancing efficiency, permitting a reduced vibration, as well.

In an outer circumferential zone of the spiral blades 47, there is disposed an impeller housing 48, and outer peripheral parts of the spiral blades 47 are arranged close to an inner circumferential surface of the impeller housing 48. And, the impeller housing 48 has a suction inlet 48*a* funnel-like formed so that water may inflow, depending on a flow speed due to a suction force of the spiral blades 47 in rotation. A body part 48*b* of the impeller housing 48 is configured to be ellipsoidally bulged so that water streams have increased pressures due to centrifugal forces of the spiral blades 47 along the hub 46 and the body 48*b* of the impeller housing 48. With an increasing number of spiral blades 47 to three and to four, there may be achieved an increasing volumetric efficiency and an increasing inflow rate to the impeller housing, as well as an increased discharge pressure.

A rear end part of the impeller housing 48 is provided with a discharge outlet 48*c* contracted to be open so that water streams pressurized and accelerated by the spiral blades 47 are further accelerated to be ejected as jet streams backward of the stern, and their reaction forces propel the vessel body.

Further, the impeller housing 48 has, behind the suction inlet 48*a* thereof and on an inner circumferential surface in front of the discharge outlet 48*c* thereof, a plurality of vertical rectification plates 49 extending in an axial direction of the impeller shaft and guide vanes 50 for rectifying swirl streams in the axial direction of the impeller shaft, so that water streams suctioned into the impeller housing 48 are supplied to start end parts of the spiral blades 47, and pressurized and accelerated swirl streams are discharged from finish end parts of the spiral blades 47, as rectified streams along the axial direction of the impeller shaft. Reference character 51 is a hanger vane for hanging down the impeller housing 48 from the vessel body 41, which hanger vane 51 is arranged in parallel to an axis of the impeller shaft to provide a restriction to complicated streams of water flow near the stern. Incidentally, reference character 52 is a cap for a fixation of the spiral blades 47, which cap 52 may however be employed as a support metal of the guide vanes 50, as their down-end parts may be connected. Reference character 53 is a rudder for the vessel body 41 to travel.

In such propulsion device, as the spiral blades 47 are rotated, water such as marine water is suctioned from the suction inlet 48*a* of the impeller housing 48. And, the water is supplied along the rectification plates 49 to the start end parts of the spiral blades 47, and transferred along continuous twisted guide surfaces of the spiral blades 47, being pressurized to be accelerated by the guide surfaces. Then, accelerated water streams are converted by the guide vanes 50 into rectified water streams in a direction of an axis of the rotation shaft, which are rearwardly ejected as yet accelerated jet streams from the discharge outlet 48*c* contracted to be open, and their reaction forces propel the vessel body. Accordingly, water streams are prevented from being dispersed, causing complicated water streams of flow near the stern, so that water streams have their pressures increased, without escaping in all directions, and are backwardly ejected to have an increased propulsive force. Further, as the impeller housing is provided in the outer circumferential zone of the spiral blades, water streams near the stern are kept from being stirred, with a reduced vibration and a reduced noise.

We claim:

1. A water jet propulsion device for vessels comprising;

a suction inlet open at a vessel bottom part in a vicinity of a stern of a vessel for suctioning water;

a suction duct for conducting suctioned water;

an impeller for pressurizing conducted water;

an ejection duct for ejecting pressurized water backward of the stern propulsion device for a vessel characterized in that on an impeller shaft provided in the impeller;

a mobile grid rotatable about an edge part of the suction inlet;

a vessel speed sensor for sensing a travel speed of the vessel;

a revolution number sensor for sensing a number of revolutions of the impeller; and a grid controller for controlling the mobile grid to rotate about the edge part of the suction inlet when the travel speed of the vessel is lowered under a computed value based on the number of revolutions of the impeller.

2. The water jet propulsion device of claim 1 wherein the impeller comprises;

an impeller housing;

an impeller shaft extending in an axial direction of the impeller housing;

a plurality of spiral blades mounted on the impeller shaft for giving swirling tendencies to pressurized water, the plurality of spiral blades being angularly spaced from each other, the plurality of spiral blades each having a radially outer peripheral part thereof close to an inner circumferential surface of the impeller housing and an axially front part thereof projecting toward a suction side of the impeller housing;

a bearing case provided at a rear end of the impeller shaft, the bearing case cooperating with the impeller housing to define therebetween a fluid passage of a basin shape; and a plurality of guide vanes disposed in the fluid passage for straightening pressurized water, the plurality of guide vanes being relatively long in the axial direction of the impeller housing and twisted.

3. The water jet propulsion claim 1, further comprising a flow introducing member provided at a front edge part of the suction inlet, the flow introducing member having an arcuate form in a side view of the vessel.

4. The water jet propulsion device of claim 1, further comprising a stabilizing plate provided in a central zone of the suction inlet, the stabilizing plate being fixed to front and rear edge parts of the suction inlet and projected downward of the vessel bottom.

5. The water jet propulsion device of claim 1, wherein the mobile grid comprises a plurality of grid members pivoted at rear end parts thereof on a rear edge part of the suction inlet.

6. The water jet propulsion device of claim 1, further comprising:

a steering nozzle disposed behind the ejection duct, the steering nozzle having an ejection outlet at a rear part thereof and a reverse ejection outlet at a bottom part thereof;

a changeover valve pivoted on a rear edge of the reverse ejection outlet; and a valve actuator for actuating the changeover valve to selectively close the reverse ejection outlet and the ejection outlet.

7. The water jet propulsion device of claim 6, further comprising a revolution number controller for controlling the number of revolutions of the impeller to be temporarily reduced when the vessel changes a sense of movement thereof, the revolution number controller being linked with the valve actuator.

8. A water jet propulsion device comprising:

an impeller housing;

an impeller shaft in said impeller housing;

a plurality of spiral blades on said impeller shaft, said plurality of spiral blades having slipped phases, said spiral blades having outer peripheral parts thereof close to an inner circumferential surface of the impeller housing and outer circumferential surface end parts thereof extending to a suction side;

at least one guide vane for rectification in fluid passage behind the spiral blades; paralleled mobile grids disposed in a front-to-rear orientation over a suction inlet to said impeller housing, said mobile grids rotatably pivoted on a rearward opening edge of said suction inlet;

a vessel speed sensor for sensing a travel speed of the vessel;

a revolution number sensor for sensing a number of revolutions of the spiral blades; and a rotation device which causes the mobile grids to separate from the suction inlet based upon a comparison of the travel speed of the vessel and the number of revolutions of the spiral blades.

* * * * *